US005767812A

United States Patent [19]

Basciano et al.

[11] Patent Number: 5,767,812

[45] Date of Patent: Jun. 16, 1998

[54] HIGH EFFICIENCY, BROADBAND, TRAPPED ANTENNA SYSTEM

[75] Inventors: Nicholas J. Basciano, Millersville; Daniel D. Reuster, Annapolis, both of Md.

[73] Assignee: Arinc, Inc., Annapolis, Md.

[21] Appl. No.: 665,297

[22] Filed: Jun. 17, 1996

[51] Int. Cl.[6] ..... H01Q 1/00

[52] U.S. Cl. ..... 343/722; 343/749; 343/751; 343/853; 343/812

[58] Field of Search ..... 343/749, 722, 343/751, 752, 810, 792, 850, 853, 859, 860, 812; H01Q 1/00

[56] References Cited

U.S. PATENT DOCUMENTS

| | | | |
|---|---|---|---|
| 2,229,865 | 1/1941 | Morgan | 343/810 |
| 3,445,849 | 5/1969 | Sanford | 343/702 |
| 4,217,589 | 8/1980 | Stahler | 343/722 |
| 4,222,053 | 9/1980 | Newcomb | 343/722 |
| 4,496,952 | 1/1985 | Newcomb | 343/722 |
| 4,604,628 | 8/1986 | Cox | 343/722 |
| 5,335,363 | 8/1994 | Basciano | 455/73 |
| 5,335,464 | 8/1994 | Vanesky et al. | 52/173.1 |
| 5,600,335 | 2/1997 | Abramo | 343/749 |

OTHER PUBLICATIONS

"Semi–vertical trap aerial for 1•8, 3•5 and 7MHz," by J.T. Beaumont, G3NGD, *Radio Communication*, Aug., 1976, pp. 592–593.

"Lightweight Trap Antennas—Some Thoughts," by Doug DeMaw, QST, Jun., 1983, pp. 15–18.

"Coaxial Cable Antenna Traps," by Robert H. Johns, QST, May, 1981, pp. 15–20.

*Primary Examiner*—Hoanganh T. Le
*Attorney, Agent, or Firm*—Oliff & Berridge, PLC

[57] ABSTRACT

The invention provides an efficient, broadband, antenna system for RF communications. The benefits of the invention include: a single integrated system for total band coverage; high system efficiency across the operating band; multiple instantaneous transmit and receive signal capability; and simple mechanical assemblies. The invention includes various configurations of multiple transceivers connected to a set of RF filters and associated impedance matching networks which are used to excite a plurality of trapped antenna elements. The new antenna system, offers control over the antenna's directivity and the antenna's driving point impedance by using sub-band systems as defined by a series of RF filters and traps which divide the physical antenna elements into various radiating lengths. Continuous coverage over the entire frequency band of interest is achieved by using different physical antenna elements for adjacent sub-bands. The utilization of sub-bands reduces the impedance matching network requirements and helps to more efficiently radiate energy over the entire frequency band of interest. The resultant higher antenna system efficiencies allow for moderate and feasible performance specifications for transmitters, receivers, and matching network components.

25 Claims, 4 Drawing Sheets

HIGH EFFICIENCY, BROADBAND, TRAPPED ANTENNA SYSTEM

BACKGROUND OF THE INVENTION

1. Field of the Invention

The present invention relates generally to high efficiency, broadband, trapped antenna systems.

2. Description of the Prior Art

The performance of any antenna system is defined as the product of the antenna's efficiency and the antenna's directivity. For wire antennas, the directivity of the antenna is strictly a function of the antenna's electrical length and the efficiency of the antenna is strictly a function of how well the input impedance of the antenna is matched to the characteristic impedance of the transceiver. The input impedance of a wire antenna is also a function of the electrical length of the antenna. While a vertical monopole antenna over a ground plane exhibits optimal gain for the frequency at which the antenna is a quarter wavelength, maximizing the efficiency of a wire antenna system over a broad frequency band requires advanced methods.

For traditional prior art antennas, inductor-capacitor circuit traps (LC traps) have been inserted into wire antennas in an effort to utilize a single wire antenna element for non-continuous multiple frequency transmission and reception. This approach usually entails that the existing wire antenna be designed for the lowest frequency (longest wavelength) of interest, and that the other frequencies of interest are sufficiently different such that the resonant bandwidths of the inserted traps do not interfere with one another. Over the years, many design variations have been implemented since the concept of trapped antennas was first patented in 1941. While many claims have been made regarding the number of resonant frequencies and the bandwidths associated with each of the resonant frequencies, all of the previous designs share one common characteristic limitation in that no previous trapped wire antenna design provides continuous coverage across the complete frequency band of interest. In order for the traditional trapped wire antenna design to function properly, there must exist gaps in the frequency band which are at least as large as the resonant bandwidths of the inductor-capacitor circuit traps.

Prior art antennas have utilized traps for operating at different frequencies mostly associated with amateur radio. While these prior assemblies are adequate for some applications, they cannot meet the broadband, efficiency, directivity, tuning response time, simultaneous transmit and receive usage, and mechanical simplicity for newer system requirements such as with frequency agile radios.

The prior art has a number of limitations. First, as explained above, the use of a single wire trapped antenna does not provide for total, continuous frequency band performance. Second, the use of numerous traps and other loading devices increases the system Q and further restricts the bandwidth of operations. Third, attempting to increase the operational bandwidth would require elaborate and time consuming impedance matching methods in unstable regions of antenna resonance. Fourth, the prior art systems are incapable of transmitting and receiving multiple, simultaneous signals. Additionally, the prior art requires elaborate mechanical assemblies.

SUMMARY OF THE INVENTION

The present invention is a system that comprises a plurality of antenna elements, a plurality of antenna traps, a plurality of bandpass filters and matching networks, and various transceiver and controller configurations.

An objective of this invention is to provide a high efficiency, broadband, wire antenna system. The system is intended to provide continuous coverage over the frequency band of interest while maintaining maximum antenna gain and stable input impedance.

Each embodiment of the invention provides a single system for total band coverage and greater efficiency. Furthermore, in each single system, fewer performance requirements for transmitter and receiver elements and matching networks of the invention are needed. The particular configurations and assemblies are beneficial to amateur, commercial, government and military applications.

A significant aspect and feature of the present invention is the use of a plurality of antenna elements having different characteristics such that regions of stable and acceptable impedance characteristics can be utilized on each antenna element for part of the total frequency band of operation. Total band coverage is achieved by combining the stable and acceptable impedance characteristics of each segment such that these segments overlap in frequency coverage enough to provide the desired frequency response across the entire band of operation.

Another significant aspect and feature of the present invention is the placement of LC traps on the antenna elements such that the antenna pattern is controlled for that segment of the antenna elements' frequency region of operation. Significant lobbing of the pattern is prevented where the LC trap acts as a band stop filter not allowing current for the intended frequency region of operation to proceed down the element. For lower frequencies of operation on that element, the trap nearest the transceiver will pass lower frequencies that are not contiguous to the frequencies segment of operation to the preceding antenna element segment, etc. Total band coverage is achieved where a plurality of antenna elements and a corresponding plurality of traps that control different segments of the total frequency band of operation overlap in operation to provide total frequency coverage of the frequency band of operation.

The teachings of the present invention are applicable to any size wire antenna with elements configured as monopoles, dipoles, arrays, dielectric loaded, and magnetic antennas or any other antenna type that is conducive to the intent of the invention using various stable and acceptable regions on each antenna element for full band coverage.

DETAILED DESCRIPTION OF PREFERRED EMBODIMENTS

The high efficiency antenna network is comprised of two or more different length wire antennas and a series of inductive-capacitive LC traps which are utilized to divide the individual wire antenna elements into various resonant lengths.

Figure 1A:
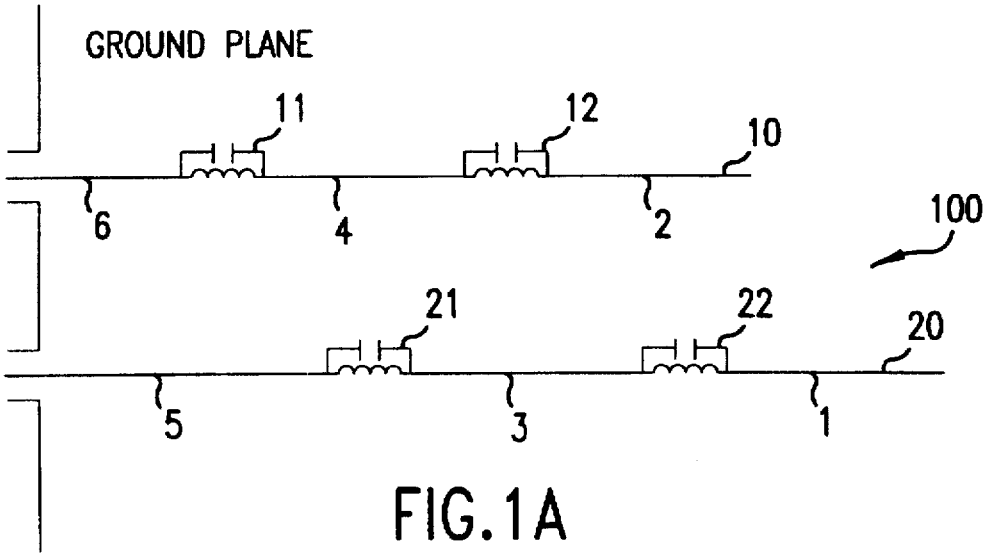
FIGS. 1(*a*) and 1(*b*) show the antenna portions of an RF communication system in its monopole and dipole configurations respectively.
Figure 1B:
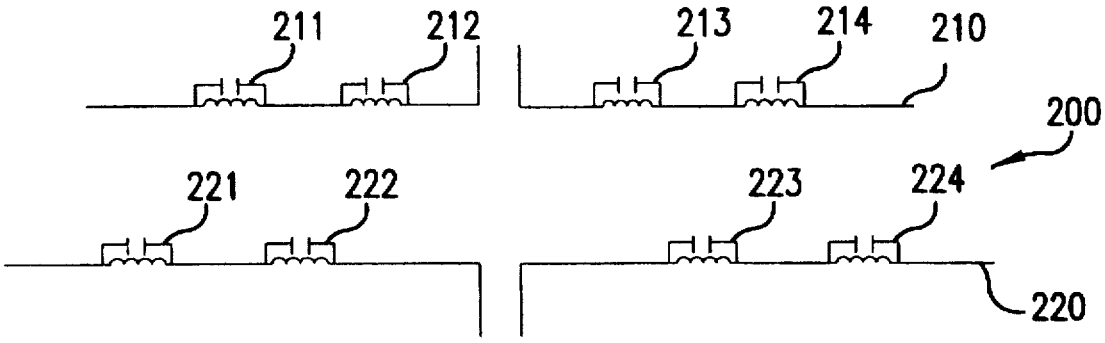

FIGS. 1(*a*) and 1(*b*) illustrate the antenna portion of the communication system in its monopole and dipole configurations, respectively. Herein, the term monopole will refer to an unbalanced antenna feed system where a ground plane (image plane) is used to simulate half of the antenna system. The term dipole will refer to a balanced antenna feed system where no ground reference is defined. Although, Figs. 1(*a*) and 1(*b*) show the antenna as including two wire elements with two inductive-capacitive traps attached to each wire, the actual antenna configuration may include an arbitrary number of wire elements each with an arbitrary number of inductive-capacitive traps associated with it.

An embodiment of one such high efficiency, broadband trapped wire antenna system, including two wire antennas, 10 and 20, and four inductive-capacitive traps 11, 12, 21, and 22, is shown in FIG. 1(*a*). In the invention, the inductive-capacitive traps serve to limit the RF current flowing along the wires at various frequencies allowing the antenna system to appear to have physical lengths which correspond directly to the wavelength of interest. In essence, the two wire antenna system is broken up into six sub-antenna systems 1–6, each of which is capable of simultaneous transmission or reception. The two wire trapped antenna network is then connected to the transmitter(s) via a series of RF filters and matching networks.

FIG. 1(*b*) illustrates the dipole embodiment. In this embodiment, the antenna system 200 includes LC traps 211–214 and 221–224.

Figure 2:
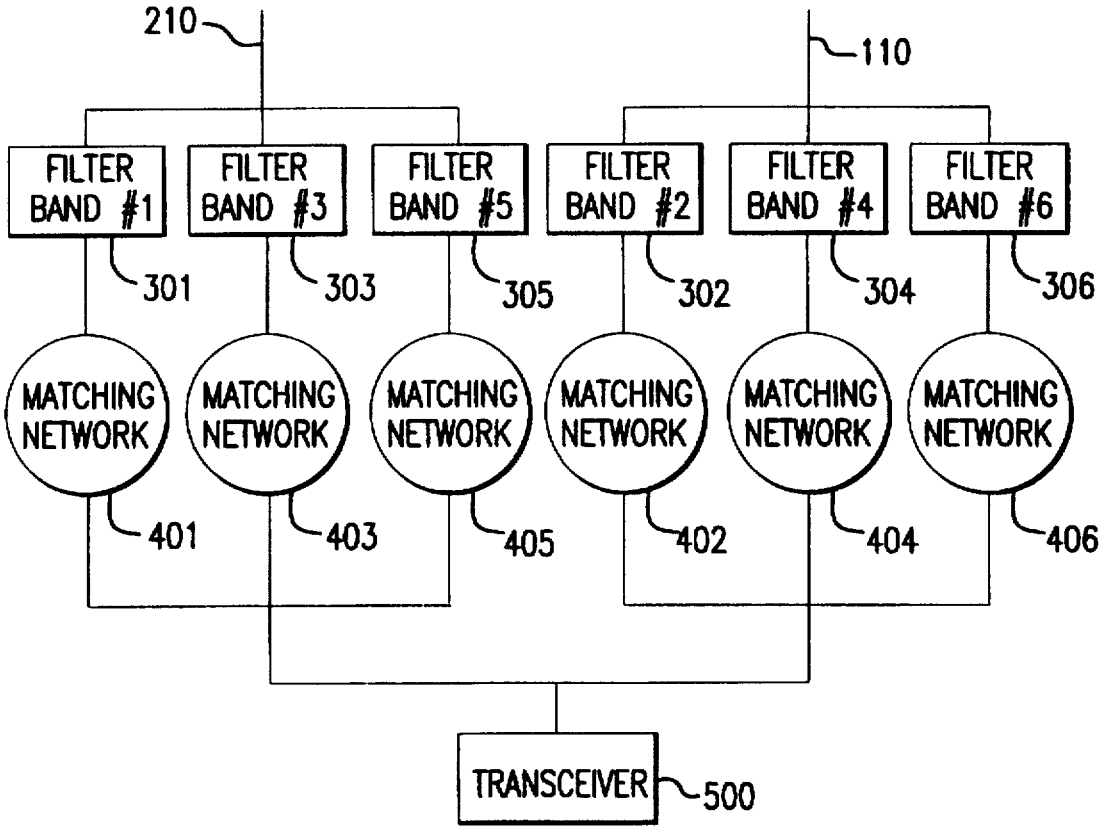
FIG. 2 illustrates the connection network portion of the RF communication system.

FIGS. 2 illustrates the connection network portion of the communication system. For every inductive-capacitive trap existing on the antenna portion of the design, there exists a band-pass filter and matching network associated with the resonant bandwidth of the trap. Suitable matching networks for the present application are disclosed in U.S. Pat. No. 5,335,464, which is fully incorporated by reference in the present application. The above-described design ensures that the proper antenna portion is excited when a given signal is transmitted or received. The matching networks may be active or passive and the network may be excited by a single or multiple transceivers.

FIG. 2 shows the connection network required to attach the antenna network shown in FIG. 1(*a*) to a single transceiver. It is the combination of the multiple trapped antenna elements and the connection network which allows the antenna system to provide complete coverage across the frequency band of interest. The invention utilizes two or more trapped wire antennas to achieve coverage over the entire frequency band of interest by designing each antenna to cover alternating portions of the frequency band. The inductive-capacitive traps are used to break down the individual wire antennas into as many sub-band antennas as required to provide high efficiency across the entire frequency band of interest.

The connection network is used both to direct the radiated signal to the correct sub-band antenna and to impedance match, if required, the resultant sub-band antennas to the transceiver. Hence, each resulting antenna sub-band has a filter impedance matching network associated with it to select the proper antenna and ensure maximum efficiency antenna efficiency, at any given frequency, is obtained by matching the characteristic impedance of the transmitter to the input impedance of the antenna. The technique of adjusting the electrical length of the wire antennas with the inductive-capacitive traps also serves as a passive first order method of stabilizing the antenna's input impedance.

In FIG. 2, connection 210 connects with wire element 20 of FIG. 1(*a*) and connection 110 connects with wire element 10 of FIG. 1(*a*). Filters 301 through 306 are selected to determine the appropriate antenna portions for the received frequency. Matching networks 401–406 are connected with filters 301–306 respectively.

Figure 3A:
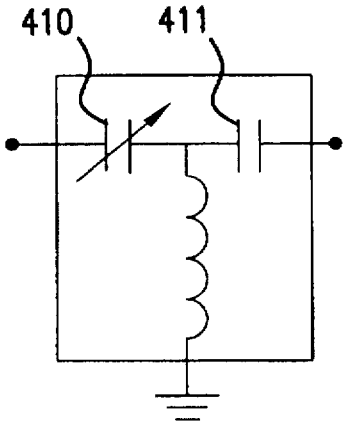
FIGS. 3(*a*) and 3(*b*) show two matching network designs.
Figure 3B:
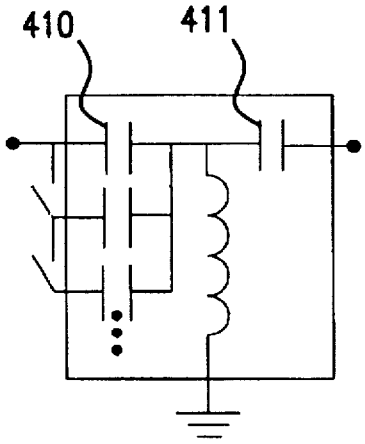

FIG. 3 shows examples of possible matching network designs for each of the antenna sub-bands. In FIG. 3(*a*) the variable capacitor port 410 will be connected to the transceiver 500 and the fixed capacitor 411 will be connected to the antenna system providing a continuous impedance matching capability. In FIG. 3(*b*), the capacitance is adjusted in discrete steps using switches that can engage various combinations of capacitors. The variable capacitance may be adjusted mechanically or electronically, or switched depending upon the needs of the system. Together, these three sub-systems (trapped antenna network, connection network, and impedance matching network) form the high efficiency, broadband, trapped wire antenna system.

The trapped antenna network is designed such that the longest wire element corresponds to the first resonant length of the lowest design frequency (largest wavelength). For the monopole case this length is approximately a quarter wavelength and for the dipole case this length is approximately a half wavelength. At this frequency (the lowest design frequency) none of the inductive-capacitive traps are active and the set of band-pass filters directs the signal to the proper antenna (antenna 20 in FIG. 1(*a*)). Because the antenna 20 is resonant at this particular frequency, the matching network does little to no work in ensuring that the antenna is properly impedance matched to the transceiver 500. As the frequency is increased, the longest wire element is no longer resonant and the matching network begins to play a more active role in ensuring that the input impedance of the antenna is properly matched to the transceiver 500. This process continues until the longest wire element is too far from resonance to function at the pre-set efficiency level. In this region, the filter set transitions the signal from the existing wire element 20 to the second longest wire element 10 whose length has been designed to the resonant length of the switch over frequency. All of the inductive-capacitive traps are still not active and all that has occurred is that the signal is transitioned to a different radiating structure which is more efficient. As the frequency is increased further, the matching network associated with the second longest antenna sub-element begins to match the impedance of the element to that of the transceiver 500. Again, this process continues until the radiation efficiency of the second longest antenna element transitions below the efficiency level of the next element. At this point, the band-pass filter networks transitions the signal back over to the antenna 20. The upper most inductive-capacitive trap 22 is active, stopping any RF current flow to the upper portion 1 of the wire. The location of the upper most inductive-capacitive trap is set such that the clipped wire element is now once again resonant at the new higher frequency. As the frequency is increased further, the matching network associated with the third sub-element adjusts to ensure that the impedance of the third antenna sub-element and transceiver 500 are properly matched. Once again, this process continues until the third longest wire element is too far from resonance to efficiently function. The signal is then once again transitioned over by the band-pass filter network to the other antenna wire 10. At this new higher frequency, the upper most inductive-capacitive trap 12 on the shorter antenna wire 10 is now active, stopping any RF current flow to the upper portion 2 of the shorter antenna wire. Once again, the clipped wire element is resonant at this higher frequency. This entire process is continued until all of the inductive-capacitive traps existing on both wire elements have been utilized. When the frequency is raised to a point that the shortest antenna element no longer radiates above the pre-set efficiency level, the antenna system has reached its upper frequency limit. While this process has been described for a two wire antenna network the design may be extended to include any number of wire elements containing any number of inductive-capacitive traps.

DESCRIPTION OF ALTERNATIVE EMBODIMENTS

Although the operation of the system is described above with particular reference to the monopole configuration, the operation of the system with a different antenna configuration is substantially similar and would be evident to one skilled in the art.

Several additional alternative embodiments are encompassed by the invention.

Figure 4:
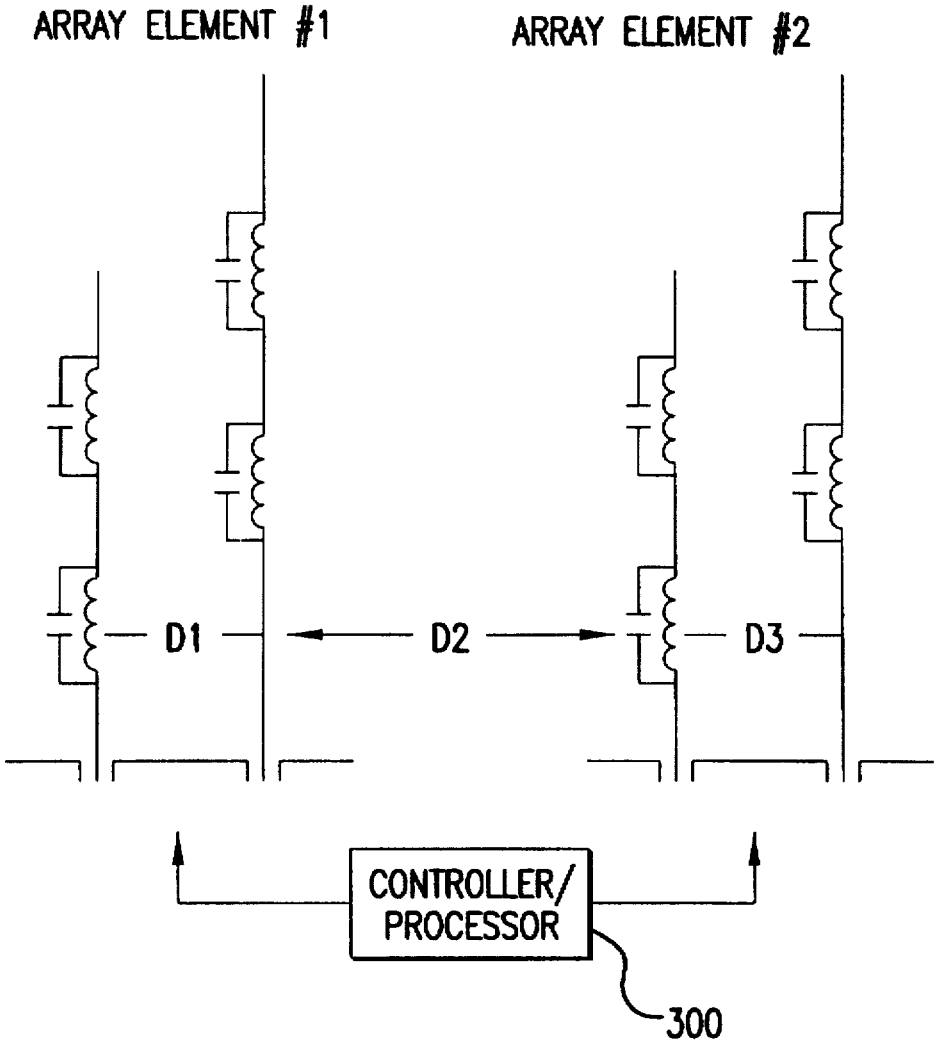
FIG. 4 shows a first alternative embodiment of a communication system.

FIG. 4 shows an alternative embodiment that provides for directional and steerable capability. The embodiment of FIG. 4 includes a two element directional array. In this alternative embodiment, a capability of a directional transmitter or receiver can be achieved by combinations of various spacing of wire elements (D1, D3), array elements (D2), and a controller/processor 300 to control phase or determine time difference of arrival. Additional wire elements and array elements arranged in various geometries can be implemented for a plurality of different operational characteristics.

Figure 5:
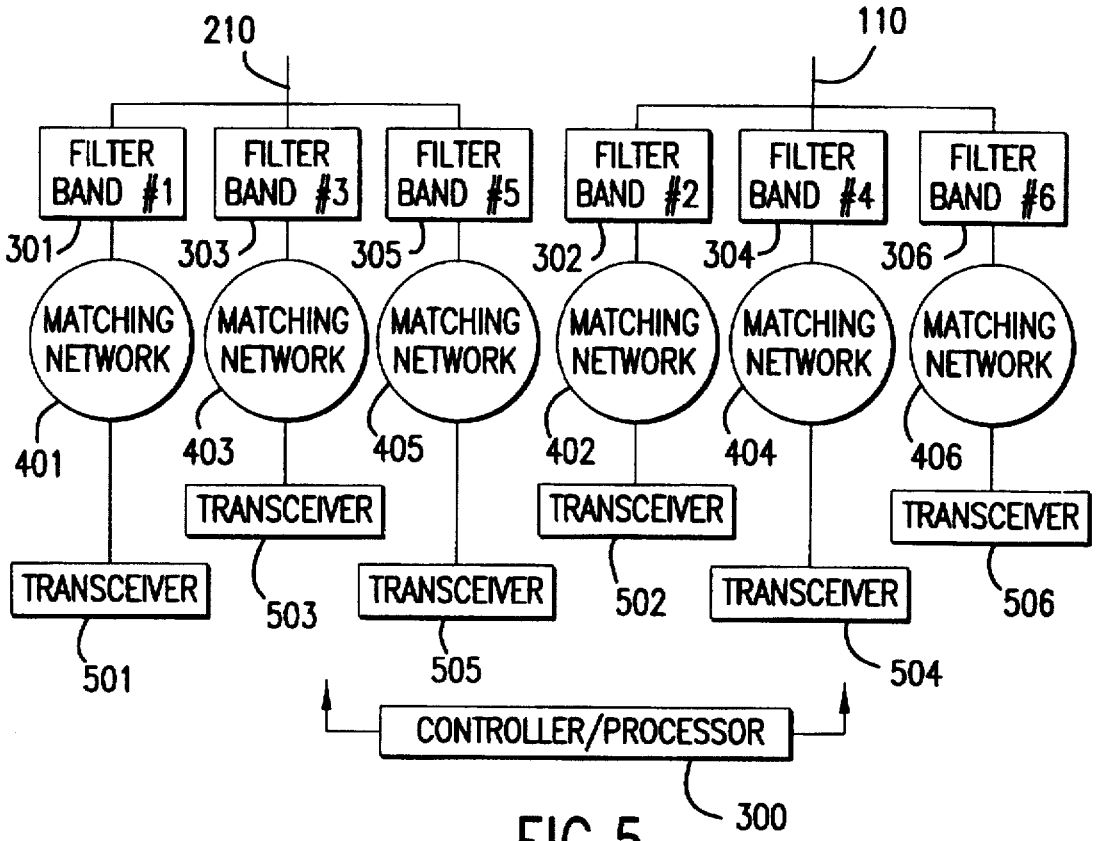
FIG. 5 shows a second alternative embodiment of the communication system.

FIG. 5 also shows an alternative where a transceiver is associated with a dedicated wire element. The embodiment of FIG. 5 includes more than one transceiver per system. In this alternative embodiment an additional capability of simultaneous and instantaneous transmit and receiver capability can be achieved. Various combinations of transceivers 501–506, matching network filters 401–406, wire elements and controllers 300 can be used to achieve a variety of different operational characteristics.

Figure 6:
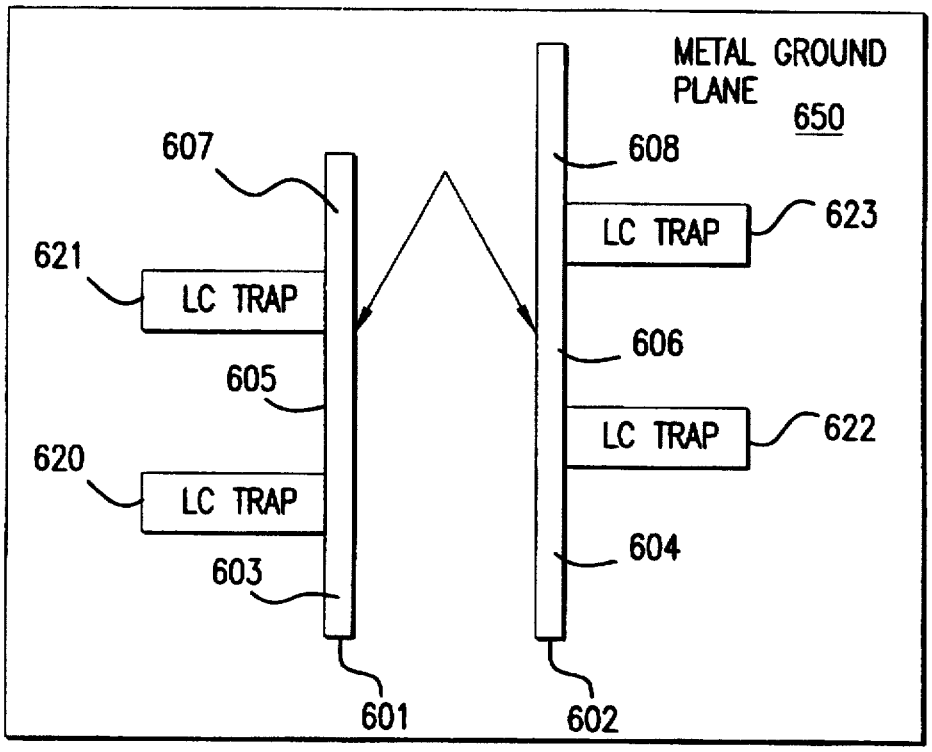
FIG. 6 shows a third alternative embodiment of the communication system of the present invention.

The embodiment of FIG. 6 illustrates an example that utilizes magnetic antenna elements. Antenna elements 601 and 602 are shown in conjunction with ground plane 650. The sub-band regions 603, 605, 607 and 604, 606, 608 of the magnetic antenna elements 601 and 602 respectively, are defined by the LC slot traps locations 620–623. In general, any embodiments which utilizes wire elements can be duplicated using magnetic elements such as monopoles, dipoles, and various arrays.

In a further embodiment of the invention, the traps on the antenna elements are omitted. The system controls transmission and reception to use regions of stable and acceptable impedance characteristics of each antenna element to achieve total band coverage. The system without traps operates substantially similarly to the system with traps as described above. The omission of traps sacrifices control of the antenna pattern, but such a system is appropriate for simpler applications.

While this invention has been described in conjunction with specific embodiments thereof, it is evident that many alternatives, modifications, and variations will be apparent to those skilled in the art. Accordingly, the preferred embodiments of the invention as set forth herein are intended to be illustrative, not limiting. Various changes may be made without departing from the scope of the invention as defined in the following claims.

What is claimed is:

1. A high efficiency, broadband, trapped wire antenna system that provides continuous coverage for a range of frequencies, comprising:

at least a longer wire element and a shorter wire element;

at least one LC trap on the longer wire element, wherein the at least one LC trap divides the longer wire element into resonant lengths, each length corresponding to a frequency sub-band; and directing means corresponding to each said at least one LC trap for directing a signal to an appropriate frequency sub-band;

wherein a first signal having a low frequency is passed to the longer wire element, a second higher frequency signal is passed to the shorter wire element, and a third signal having a frequency higher than the second signal is directed with the directing means to the longer wire element.

2. The antenna system of claim 1, wherein the directing means comprises a band-pass filter corresponding to each LC trap.

3. The antenna system of claim 2, wherein the directing means further comprises an impedance matching network corresponding to each LC trap.

4. The antenna system of claim 3, wherein each impedance matching network component that corresponds to each frequency sub-band on each wire element provides impedance matching for other components of the system for operation.

5. The antenna system of claim 3, wherein each impedance matching network comprises a combination of active and passive components.

6. The antenna system of claim 1, wherein the longer wire element and the shorter wire element are monopole antennas.

7. The antenna system of claim 1, wherein the longer wire element and the shorter wire element are dipole antennas.

8. The antenna system of claim 1, wherein the longer wire element and the shorter wire element are arrays.

9. The antenna system of claim 1, wherein the longer wire element and the shorter wire element are magnetic elements.

10. The antenna system of claim 1, wherein the longer wire element and the shorter wire element are dielectrically loaded.

11. The antenna system of claim 1, further comprising at least one transceiver connected to the antenna system through the directing means, wherein the at least one transceiver element allows for single and multiple simultaneous and instantaneous transmit and receive capability.

12. The antenna system of claim 11, further comprising a controller that coordinates the activities of the directing means, the antenna elements and the transceiver.

13. The antenna system of claim 1, wherein the at least one LC trap is located on the longer wire element such that an antenna pattern is controlled respectively within each said resonant length.

14. A method for achieving continuous broadband coverage for a range of frequencies with an antenna system, wherein the antenna system comprises at least a longer wire element and a shorter wire element, at least one LC trap on the longer wire element, wherein the at least one LC trap divides the longer wire element into resonant lengths, each length corresponding to a frequency sub-band, and directing means corresponding to each said at least one LC trap for directing a signal to an appropriate frequency sub-band, the method comprising:

passing a first signal having a low frequency within the selected frequency range to the longer wire element;

passing a second higher frequency signal to the shorter wire element;

directing, with the directing means, a third signal, having a frequency higher than the second signal to the longer wire element; and activating one LC trap, thereby stopping current flow to a first sub-band of the longer wire element.

15. The method of claim 14, wherein the directing step comprises directing signals with a directing means comprising a band-pass filter corresponding to each LC trap.

16. The method of claim 15, wherein the directing step further comprises directing the signal with an impedance matching network corresponding to each LC trap.

17. The method of claim 16, comprising providing impedance matching for other components of the antenna system for operation with an impedance matching network component that corresponds to each sub-band on each antenna element.

18. The method of claim 16, wherein each impedance matching network comprises a combination of active and passive components.

19. The method of claim 14, comprising passing the signals to monopole antennas.

20. The method of claim 14, comprising passing the signals to dipole antennas.

21. The method of claim 14, comprising passing the signals to antenna elements that are arrays.

22. The method of claim 14, comprising passing the signals to antenna elements that are magnetic elements.

23. The method of claim 14, comprising passing the signals to antenna elements that are dielectrically loaded elements.

24. The method of claim 14, further comprising providing single and multiple simultaneous and instantaneous transmit and receive capability with a transceiver connected to the antenna system through the directing means.

25. The method of claim 24, further comprising coordinating activities of the directing means, the antenna elements and the transceiver with a controller.

* * * * *